US006870144B2

(12) United States Patent
Ryu et al.

(10) Patent No.: US 6,870,144 B2
(45) Date of Patent: Mar. 22, 2005

(54) INVERTER CIRCUIT OF INDUCTION HEATING RICE COOKER

(75) Inventors: Seung Hee Ryu, Anyang-si (KR); Byeong Wook Park, Inchun-si (KR)

(73) Assignee: LG Electronics Inc., Seoul (KR)

( * ) Notice: Subject to any disclaimer, the term of this patent is extended or adjusted under 35 U.S.C. 154(b) by 22 days.

(21) Appl. No.: 10/428,947

(22) Filed: May 5, 2003

(65) Prior Publication Data

US 2004/0118832 A1 Jun. 24, 2004

(30) Foreign Application Priority Data

Dec. 24, 2002 (KR) ..... 10-2002-0083488
Dec. 24, 2002 (KR) ..... 10-2002-0083489
Dec. 24, 2002 (KR) ..... 10-2002-0083487

(51) Int. Cl.[7] ..... H05B 6/06; H05B 6/12

(52) U.S. Cl. ..... 219/626; 219/620; 219/664; 219/663; 363/41; 363/97

(58) Field of Search ..... 219/620–627, 219/661–668, 715–721; 363/37, 41, 49, 97, 98, 74

(56) References Cited

U.S. PATENT DOCUMENTS 3,593,103 A * 7/1971 Chandler et al. ..... 363/174
5,854,473 A * 12/1998 Malnoe ..... 219/626
6,075,715 A * 6/2000 Maehara et al. ..... 363/37

FOREIGN PATENT DOCUMENTS

JP 1-117293 * 5/1989 ..... 219/716

* cited by examiner

*Primary Examiner*—Philip H. Leung
(74) *Attorney, Agent, or Firm*—Birch, Stewart, Kolasch & Birch, LLP

(57) ABSTRACT

An inverter circuit of an induction heating rice cooker which controls a switching frequency of an inverter in a variable manner according to a variation in an input voltage and drives the inverter at the controlled switching frequency. The inverter circuit comprises a power supply circuit for rectifying and filtering a commercial alternating current (AC) voltage to supply the input voltage to the induction heating rice cooker. The inverter performs a switching operation based on the input voltage from the power supply circuit to heat the rice cooker. The inverter circuit further comprises an inverter driving circuit for outputting a drive pulse to control the switching frequency of the inverter in the variable manner according to the input voltage from the power supply circuit and drive the inverter at the controlled switching frequency. Heating power of the rice cooker does not vary with the variation in the input voltage and an internal device of the inverter is prevented from being damaged due to the variation in the input voltage, thereby enhancing durability of a product and reliability of the inverter circuit.

15 Claims, 13 Drawing Sheets

INVERTER CIRCUIT OF INDUCTION HEATING RICE COOKER

BACKGROUND OF THE INVENTION

1. Field of the Invention

The present invention relates to an inverter circuit driving device of an induction heating rice cooker, and more particularly to an inverter circuit of an induction heating rice cooker which is capable of varying the width of a drive pulse to an inverter with a variation in an input voltage so as to vary a switching frequency of the inverter, thereby stabilizing heating power generated by a switching operation of the inverter and preventing an internal device of the inverter from being damaged due to the variation in the input voltage.

2. Description of the Related Art

FIG. 1 is a sectional view of a general induction heating rice cooker. As shown in this drawing, the rice cooker comprises a body 1, an inner pan 2 disposed inside of the body 1 for containing an object to be cooked, and a cooking heater 3 mounted in a portion of the body 1 beneath the inner pan 2 or an inner suffice of the body 1 for cooking the object contained in the inner pan 2.

This rice cooker is a home appliance which heats and cooks the object contained therein at more than a predetermined temperature, and is mainly used to boil rice. It is also used to retain warmth of food for a long time. A user puts rice or other additive food and an appropriate amount of water in the inner pan 2 and, in turn, the inner pan 2 in the body 1. The user then sets an amount to be cooked and a cooking mode and enters a cooking command containing the settings to the rice cooker. In order to automatically cook in response to the cooking command, the rice cooker comprises a controller for controlling a cooking operation of the cooker.

The rice cooker is of a specific type based on how cooking heat is provided to the inner pan 2. For example, an induction coil having a plurality of uniformly-spaced turns is formed in a portion of the cooker body 1 receiving the inner pan 2, and induced current is generated in the inner pan 2, which is made of a magnetic substance, due to a magnetic field resulting from the flow of current in the coil, so as to heat the inner pan 2. This type of rice cooker is a so-called induction heating rice cooker.

FIG. 2 is a block diagram showing the construction of a conventional inverter circuit of the induction heating rice cooker.

The inverter circuit is applied to the induction heating rice cooker to induction-heat an object (load) to be cooked by controlling a power switching device therein. The power switching device performs a switching operation in response to a control signal to apply a drive voltage to the induction coil for the inner pan so as to heat the inner pan. The inverter circuit comprises a power source 10 for supplying a commercial alternating current (AC) voltage, a rectifier 20 for rectifying the AC voltage supplied by the power source 10, a filter 30 for filtering an output voltage from the rectifier 20, and an inverter 40 for performing a switching operation based on an output voltage from the filter 30 to apply a drive voltage to the induction coil for the inner pan.

The inverter circuit further comprises a trigger circuit 50 for varying the operation or state of a specific circuit at a rising or falling edge of a pulse. The trigger circuit 50 generates a drive pulse to drive a switch of the inverter 40.

The switch is turned on when the drive pulse goes "high" in level, and off when the drive pulse goes "low" in level. Here, a voltage applied across the switch is referred to as a "switched voltage".

The inverter circuit further comprises a switch driver 60 for transferring the drive pulse from the trigger circuit 50 to the inverter 40 to drive the switch of the inverter 40.

The switch of the inverter 40 is adapted to perform the switching operation in response to the drive pulse transferred from the switch driver 60 to generate heating power, which is used as a heating source for cooking a load to be heated (an object to be cooked). A withstand voltage of the switch against the switched voltage is limited in its range according to specifications of the switch. In general terms, the higher the withstand voltage, the higher the cost of the switch, resulting in an increase in production cost.

Note that a commercial AC voltage from a power plant may have input/output characteristics varying with time zones/regions or be unstably supplied due to noise. In this case, the varying AC voltage is supplied as a drive voltage to the inverter 40, which then performs the switching operation at an abnormal frequency resulting from the unstable drive voltage, causing a variation in the heating power. As a result, even though a user enters the same cooking command with respect to the same object to be cooked, he/she cannot obtain a desired cooking result because of a variation in the heating power, resulting in the inconvenience of use and unreliability of the product.

Particularly, in the case where the AC voltage increases abruptly, the switched voltage across the switch may exceed the withstand voltage of the switch, thereby damaging the switch and reducing durability of the product.

In order to prevent the above problem, the conventional inverter circuit additionally includes a separate current transformer for sensing the amount of current flowing to the switch, or a separate protection circuit for sensing the amount of current flowing to the inverter 40 or the level of a voltage applied thereto, thereby increasing a production cost and, thus, an economic burden on a consumer.

FIG. 3 is a graph illustrating an input voltage-to-switched voltage relation of the conventional inverter circuit, and FIG. 4 is a graph illustrating a constant-power control method of the conventional inverter circuit. A description will hereinafter be given of characteristics of the conventional inverter circuit with reference to FIGS. 3 and 4.

Referring first to FIG. 3, the reference numeral G1 denotes a waveform of an input voltage to the inverter, and G2 denotes a waveform of a switched voltage applied across the switch. In this graph, the X-axis represents time and the Y-axis represents a voltage level. A commercial AC voltage of 220V–60 Hz is passed through the rectifier and filter and then applied as an input voltage of 220V–120 Hz to the inverter. The waveform G1 corresponds to one period of the input voltage to the inverter.

The switch performs the switching operation for each period of the input voltage corresponding to the waveform G1 in response to the drive pulse from the trigger circuit and thus generates a switched voltage which is higher in level than the input voltage.

At this time, the switched voltage across the switch must not exceed the withstand voltage of the switch so as to guarantee the normal switching operation without damaging the switch. However, seeing the waveform G2 of the switched voltage, a portion of the waveform G2 corresponding to ½ of a period of the switched voltage and portions in the vicinity thereof form a ridge of a sinusoidal wave, and the switched voltage may exceed the withstand voltage of the switch due to its abrupt increase in those portions.

The constant-power control method of the conventional inverter circuit, illustrated in the graph of FIG. 4, is employed in the induction heating rice cooker to maintain the heating power from the inverter 40 at a constant level.

In FIG. 4, the reference numeral ② denotes a drive pulse for the switching operation of the inverter in the normal state, ②' denotes switched current flowing through the switch when the drive pulse is "high" in level, and ②" denotes a switched voltage applied across the switch by the switched current. The drive pulse ②, switched current ②' and switched voltage ②" in the normal state are indicated by solid lines.

Where a variation or noise occurs in the input voltage, the inverter circuit performs a constant-power control operation by adjusting a turn-on period of time of the drive pulse from the trigger circuit. That is, in order to lower the heating power from the inverter, the inverter circuit reduces a high-level width of the drive pulse, as indicated by ①, by shortening the turn-on time period of the drive pulse. As a result, the amount of the switched current flowing through the switch is reduced as indicated by ①' and the switched voltage applied across the switch is thus lowered as indicated by ①". Consequently, the heating power is lowered.

On the other hand, in order to raise the heating power from the inverter, the inverter circuit increases the high-level width of the drive pulse, as indicated by ③, by lengthening the turn-on time period of the drive pulse. As a result, the amount of the switched current flowing through the switch is increased as indicated by ③' and the switched voltage across the switch is thus raised as indicated by ③". Consequently, the heating power is raised.

FIG. 5*a* is a graph illustrating a switching frequency-to-heating power relation of the conventional inverter circuit, and FIG. 5*b* is a graph illustrating a switching frequency-to-switched voltage relation of the conventional inverter circuit. A description will hereinafter be given of the problems with a conventional constant-power control method using a single frequency with reference to FIGS. 5*a* and 5*b*.

It can be seen from FIG. 5*a* that the switching frequency and the heating power are in inverse proportion to each other. In this connection, it is preferred to make the switching frequency lower to raise the heating power in order to rapidly heat the load (inner pan).

It can be seen from FIG. 5*b* that the switching frequency and the switched voltage across the switch are in inverse proportion to each other. In this regard, if the switching frequency is made to be lower to raise the heating power on the basis of the relation of FIG. 5*a*, the switched voltage is raised rather on the basis of the relation of FIG. 5*b*, so it may exceed the withstand voltage of the switch, which leads to reductions in durability of the product and reliability of the induction heating rice cooker.

High heating power is generally required to shorten a heating period of time of the rice cooker. To this end, the switching operation of the inverter can be controlled under the condition that the switching frequency is fixed at A Hz. In this case, although the heating power of the rice cooker is raised as shown in FIG. 5*a*, the switched voltage is raised together so that it may exceed the withstand voltage of the switch and in turn damage the switch. In order to avoid this problem, a manufacturer may use a high-cost switch with a high withstand voltage instead of the above switch. However, the use of the high-cost switch increases a production cost and, thus, an economic burden on a consumer.

On the other hand, provided that the switching operation of the inverter is controlled under the condition that the switching frequency is fixed at B Hz, the switched voltage is lowered as shown in FIG. 5*b*, thereby making it possible to protect the switch. In this case, however, the heating power of the rice cooker is lowered, too, so the load (inner pan) to be heated cannot be rapidly heated. This reduces a heating efficiency and causes inconvenience to a user.

SUMMARY OF THE INVENTION

Therefore, the present invention has been made in view of the above problems, and it is an object of the present invention to provide an inverter circuit of an induction heating rice cooker which is capable of controlling a switching frequency of an inverter in a variable manner according to a variation in an AC voltage to the inverter circuit and performing a switching operation of the inverter at the controlled switching frequency, in order to prevent a switch determining the supply of a drive voltage for the heating of the induction heating rice cooker from being damaged as well as to raise heating power of the rice cooker, so that a margin of a switched voltage across the switch is increased to enhance durability of a product, no high-cost switch is required to curtail a production cost, and power of the inverter does not vary greatly with variations in a load to be heated and in the AC voltage, thereby enhancing stability and reliability of the inverter circuit.

In accordance with one aspect of the present invention, the above and other objects can be accomplished by the provision of an inverter circuit of an induction heating rice cooker, comprising: power supply means for rectifying and filtering a commercial alternating current (AC) voltage to supply an input voltage to the induction heating rice cooker; an inverter for performing a switching operation based on the input voltage from the power supply means to heat the rice cooker; and inverter driving means for outputting a drive pulse to control a switching frequency of the inverter in a variable manner according to the input voltage from the power supply means and drive the inverter at the controlled switching frequency.

In accordance with another aspect of the present invention, there is provided an inverter circuit of an induction heating rice cooker, comprising: power supply means for rectifying and filtering a commercial AC voltage to supply an input voltage to the induction heating rice cooker; an inverter for performing a switching operation based on the input voltage from the power supply means to heat the rice cooker; constant-power reference level generation means for generating a constant-power reference level of the rice cooker on the basis of a variation in the AC voltage and a variation in a load of the rice cooker; and inverter driving means for outputting a drive pulse to control a switching frequency of the inverter in a variable manner according to a difference between the constant-power reference level and a level of the AC voltage so as to maintain power of the inverter at a constant level.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings. An inverter circuit of an induction heating rice cooker according to the present invention can be implemented as first and second embodiments depending on its different internal constructions, which are shown respectively in FIGS. 6 and 9.

Figure 6:
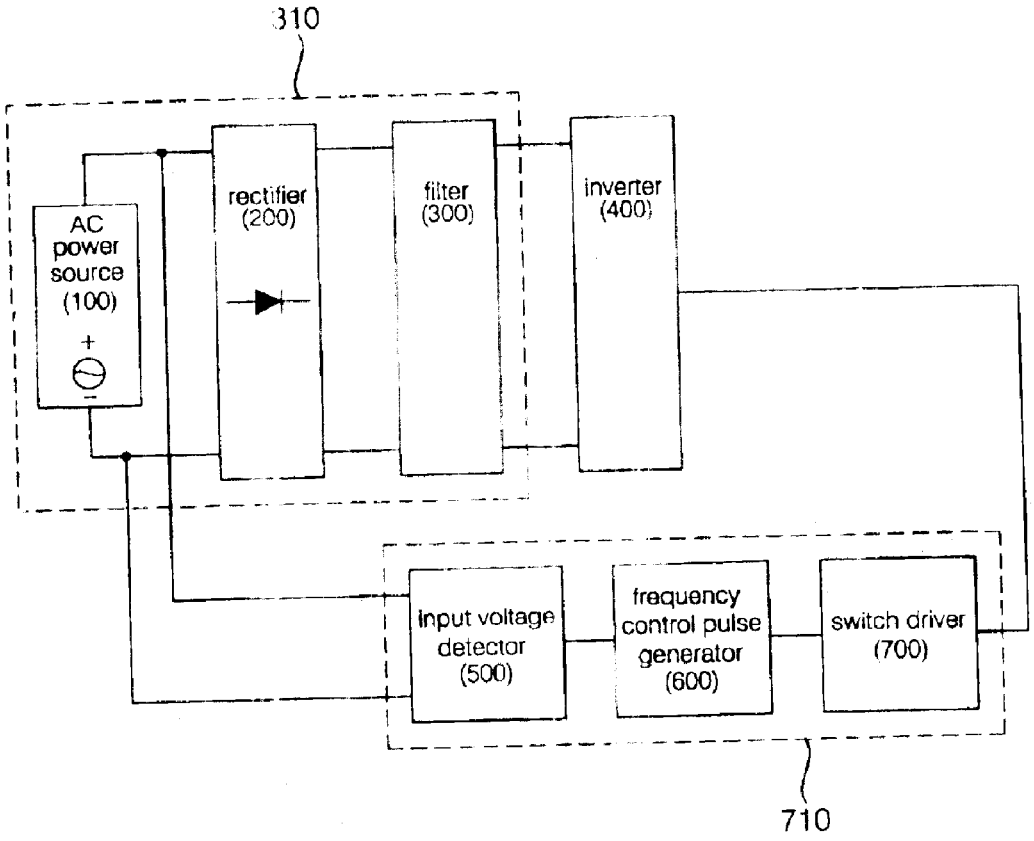
FIG. 6 is a block diagram showing a first embodiment of an inverter circuit of an induction heating rice cooker in accordance with the present invention.

The first embodiment of the inverter circuit will first be described with reference to FIG. 6.

The inverter circuit includes a switch, and acts to drive a switching operation of the switch in response to a control signal that a controller (not shown) generates in response to a cooking command containing a heating temperature, heating time, cooking mode, etc. set by a user, to apply a drive voltage to an induction coil for an inner pan of the induction heating rice cooker so as to heat the inner pan. Namely, the inner pan containing an object to be cooked is a load to be heated, and the inverter circuit removes the load by applying the drive voltage to the induction coil for the inner pan.

To this end, the inverter circuit basically comprises a power supply circuit 310 including an AC power source 100 for supplying a commercial AC voltage, a rectifier 200 for rectifying the AC voltage supplied by the power source 100 and a filter 300 for filtering an output voltage from the rectifier 200, and an inverter 400 for performing a switching operation based on an output voltage from the power supply circuit 310 to apply a drive voltage to the induction coil for the inner pan so as to heat the inner pan.

The AC power source 100 is adapted to supply a commercial AC voltage of 220V–60 Hz to the induction heating rice cooker. The rectifier 200 is adapted to rectify the AC voltage supplied from the AC power source 100 through rectification diodes to output a direct current (DC) voltage of 220V–120 Hz.

The filter 300 is adapted to filter the output DC voltage from the rectifier 200 and output the resulting DC voltage as an input voltage to the inverter 400.

The inverter 400 includes a switch for applying the drive voltage to the induction coil. The switch acts to perform the switching operation based on the input voltage from the filter 300 to heat the induction coil for the inner pan.

Figure 1:
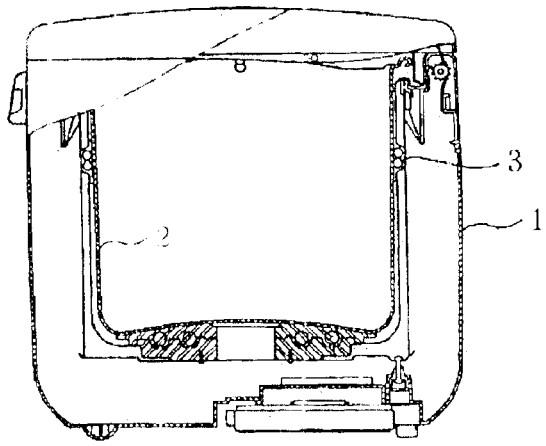
FIG. 1(Prior Art)
FIG. 1 is a sectional view of a general induction heating rice cooker.
Figure 2:
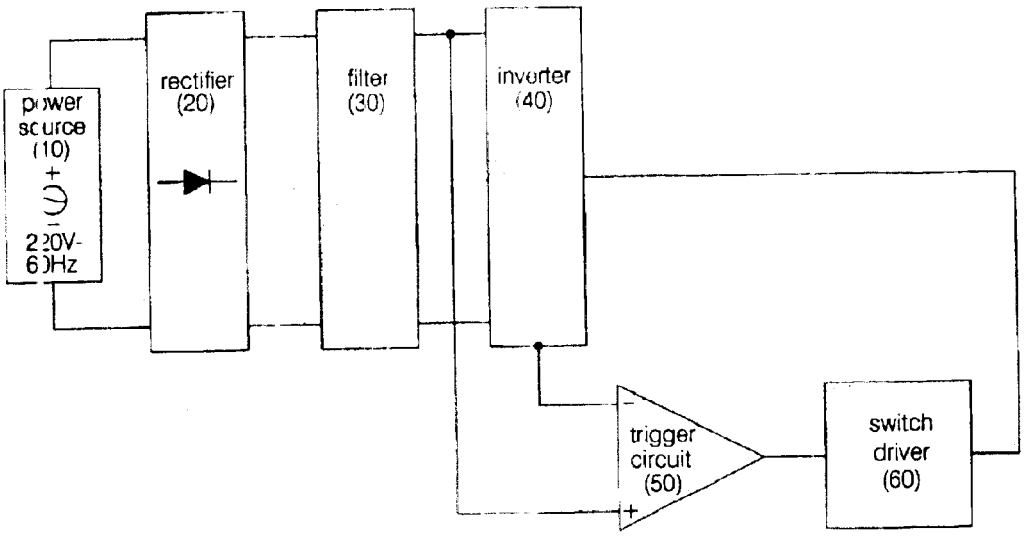
FIG. 2(Prior Art)
FIG. 2 is a block diagram showing the construction of a conventional inverter circuit of the induction heating rice cooker.

The AC power source 100, rectifier 200, filter 300 and inverter 400 are substantially the same in construction as those in the conventional inverter circuit, stated previously with reference to FIG. 2. According to the present embodiment, the inverter circuit further comprises an inverter driving circuit 710 for controlling the switching operation of the inverter 400. The inverter driving circuit 710 includes an input voltage detector 500, a frequency control pulse generator 600 and a switch driver 700.

The input voltage detector 500 is directly connected to plus and minus terminals of the AC power source 100 to detect the level and frequency of the AC voltage supplied from the AC power source 100, so as to prevent the switch from being damaged where the AC voltage is subject to a variation resulting from noise or is unstable in its input/output characteristics.

Figure 7:
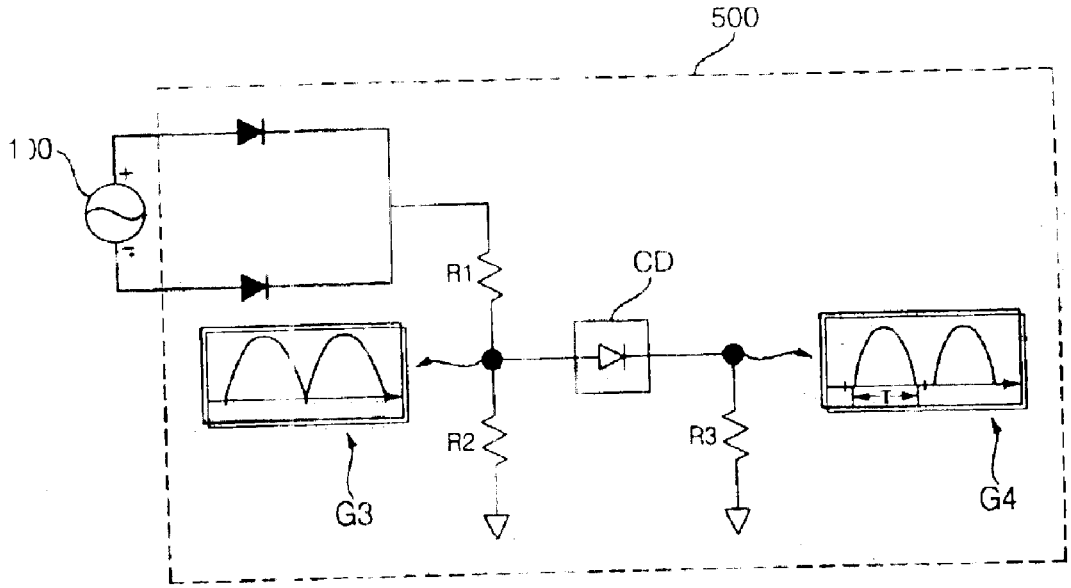
FIG. 7 is a view showing input/output signals of an input voltage detector applied to the first embodiment of the inverter circuit.

The operation of the input voltage detector 500, applied to the inverter driving circuit 710 according to the present embodiment, will hereinafter be described with reference to FIG. 7, which is a view showing input/output signals of the input voltage detector 500.

The AC voltage of 220V–60 Hz supplied from the AC power source 100 is rectified through the rectification diodes into the DC voltage of 220V–120 Hz as indicated by G3. A voltage of $$220\ (V) \times \frac{R2}{R1 + R2}$$

is applied to a node between resistors R1 and R2 since the DC voltage is divided in a ratio of R1:R2. The voltage at the node is transferred to a diode connected in series to the node.

The series-connected diode functions to clamp the voltage at the node at a predetermined reference level so that it does not exceed the reference level. Assuming that one general diode has a threshold voltage of 0.7V, the node voltage is clamped at 0.7V so that it does not exceed the threshold value. In this regard, an input voltage can be clamped at a level of (0.7×the number of diodes)V by adjusting the number of series-connected diodes, thereby making it possible to limit a positive (+) period of an output voltage.

This clamping operation is performed for the purpose of limiting a variable-frequency control period T to within a predetermined range before generating a drive pulse having a width varying with a variation in the AC voltage supplied to drive the switch.

It should be noted that the diode circuit connection can be omitted for the variable-frequency control over the overall period of the AC voltage. However, because the switch of the inverter 400 is liable to be damaged at a ridge of the AC voltage, it is preferred to limit the variable-frequency control period by connecting one or more diodes in series.

A voltage applied to a node between a cathode of the series-connected diode and a resistor R3 has a waveform as indicated by G4. The series-connected diode is a so-called clamping diode CD, and a voltage passed through the clamping diode is a so-called clamped voltage.

The above clamped voltage is inputted to the frequency control pulse generator 600, which is preferably implemented with an integrated circuit (IC). The frequency control pulse generator 600 functions to adjust an operating frequency of the switch by performing a pulse width modulation (PWM) operation based on the clamped voltage.

Figure 5A:
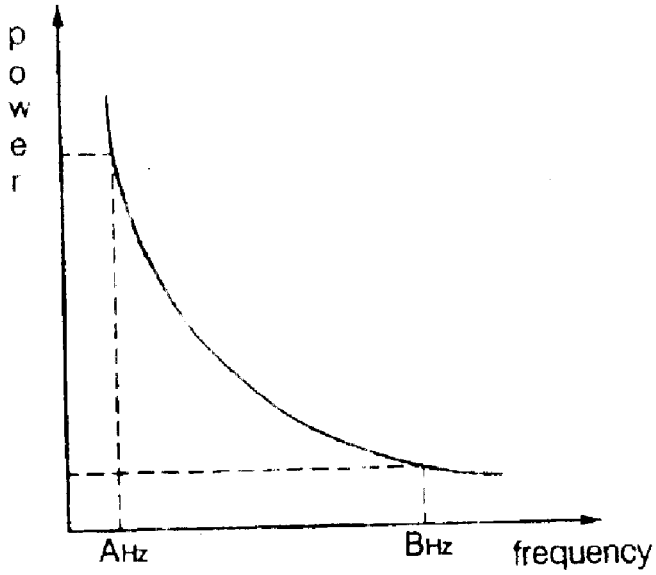
FIG. 5a(Prior Art)
FIG. 5*a* is a graph illustrating a switching frequency-to-heating power relation of the conventional inverter circuit.

In other words, the frequency control pulse generator 600 is adapted to control the operating frequency of the switch in a variable manner for a positive (+) period of the clamped voltage from the clamping diode CD. In the case where the clamped voltage is lower than a predetermined reference level, the frequency control pulse generator 600 generates a drive pulse having a wider pulse width so that the inverter 400 performs the switching operation at a lower frequency, thereby causing heating power to be raised on the basis of the relation of FIG. 5*a*.

Figure 5B:
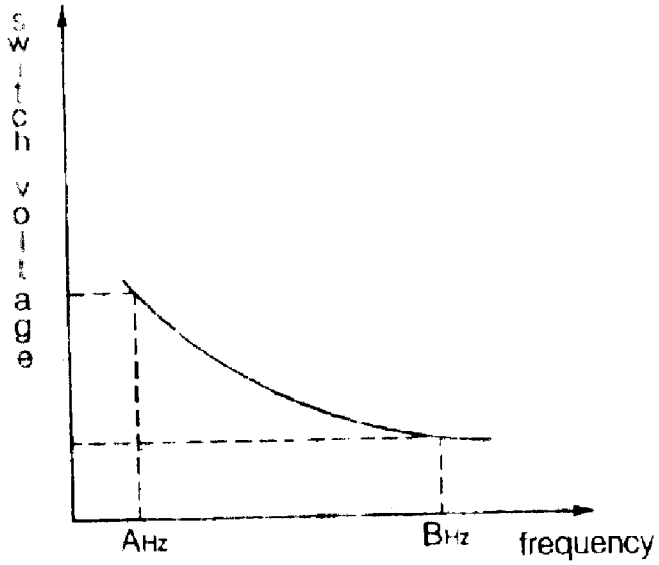
FIG. 5b(Prior Art)
FIG. 5*b* is a graph illustrating a switching frequency-to-switched voltage relation of the conventional inverter circuit.

On the contrary, in the case where the clamped voltage is higher than the predetermined reference level, the frequency control pulse generator 600 generates a drive pulse having a narrower pulse width so that the inverter 400 performs the switching operation at a higher frequency, thereby causing a switched voltage to be lowered on the basis of the relation of FIG. 5*b*. As a result, the switch can be prevented from being damaged due to an increase in the input voltage.

The switch driver 700 is adapted to transfer an output drive pulse from the frequency control pulse generator 600 to the inverter 400 to drive the switch of the inverter 400 so as to control a switching frequency of the inverter 400 in the variable manner.

Figure 8:
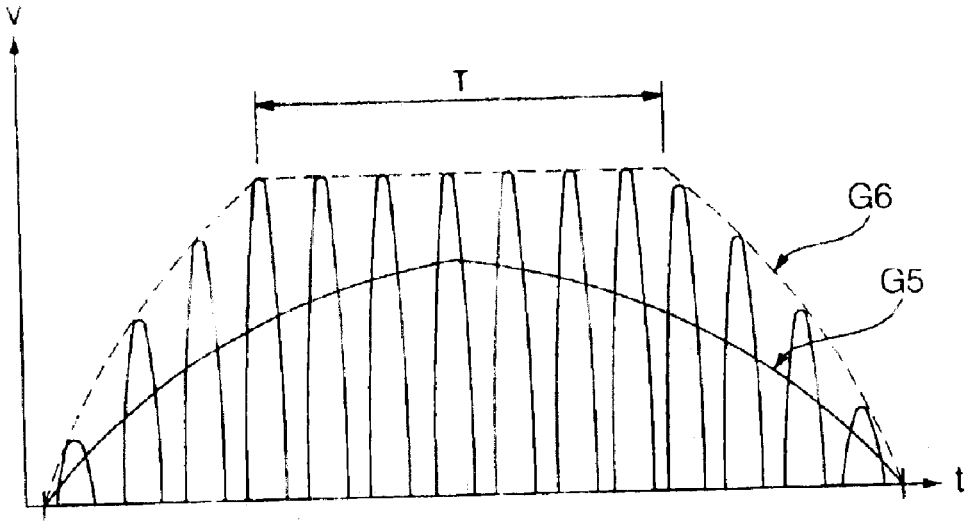
FIG. 8 is a graph illustrating an input voltage-to-switched voltage relation of the first embodiment of the inverter circuit.

FIG. 8 shows a waveform G6 of a switched voltage applied across the switch when being driven in response to the drive pulse and a waveform G5 of an input voltage to the inverter 400.

Figure 3:
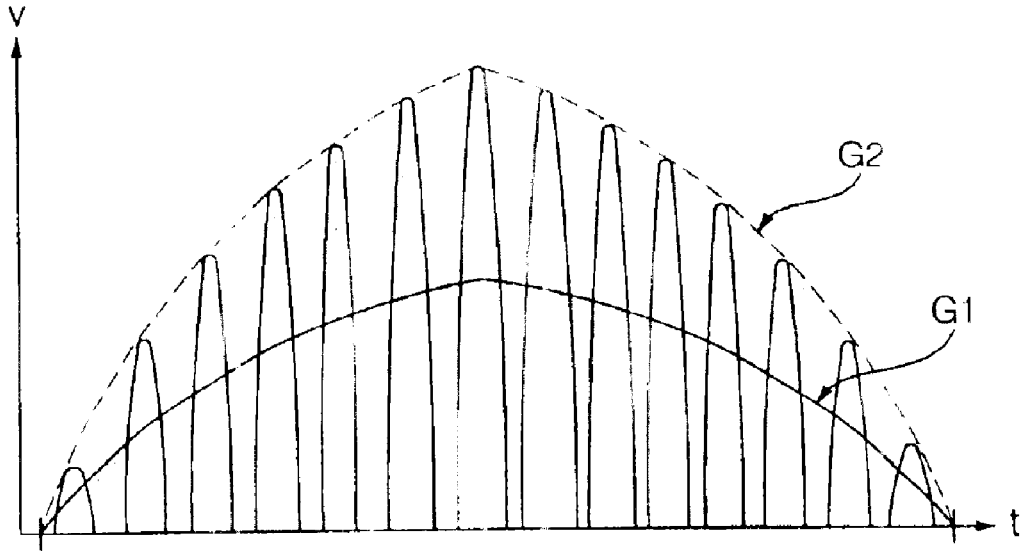
FIG. 3(Prior Art)
FIG. 3 is a graph illustrating an input voltage-to-switched voltage relation of the conventional inverter circuit.
Figure 4:
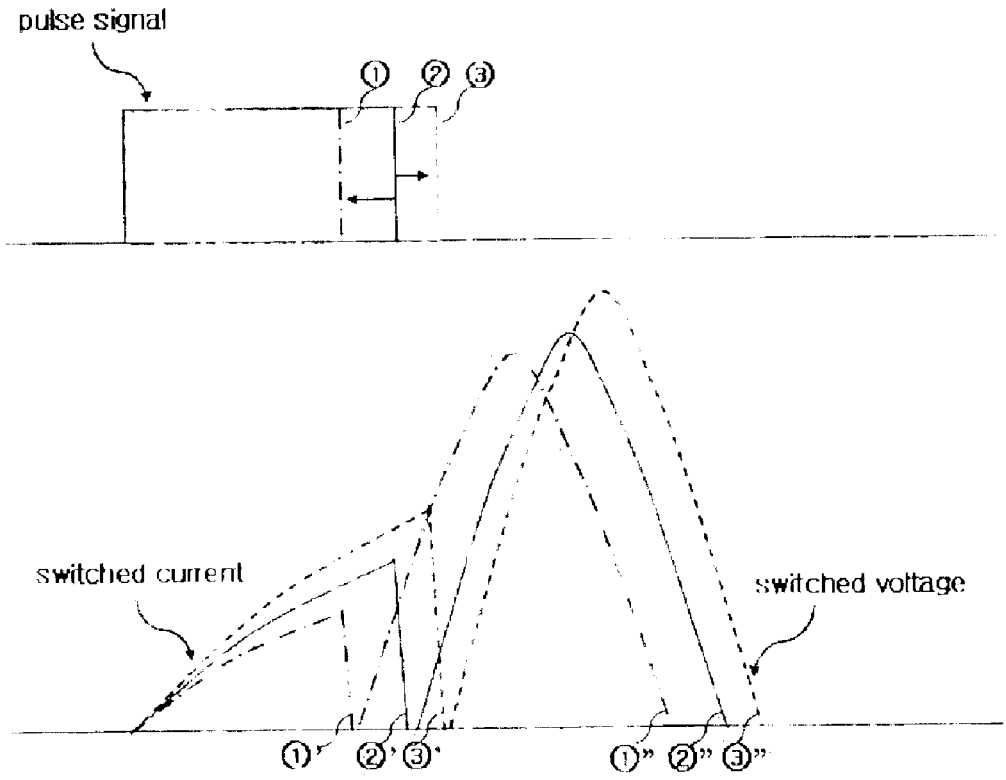
FIG. 4(Prior Art)
FIG. 4 is a graph illustrating a constant-power control method of the conventional inverter circuit.

In the conventional inverter circuit, as shown in FIG. 3, the switched voltage waveform G2 is directly influenced by a variation in the input voltage because it follows the input voltage waveform G1. However, in the present inverter circuit, the frequency control pulse generator 600 controls the switching frequency of the inverter 400 in the variable manner for the positive (+) period T of the clamped voltage in such a manner that the switched voltage is raised when the input voltage is lower in level, and it is limited in its upper level when the input voltage is higher in level, as seen from the waveform G5 of the input voltage. As a result, the switched voltage waveform G6 is flat compared with the input voltage waveform G5 for the positive (+) period T of the clamped voltage.

In other words, as the clamped voltage is raised, the switching frequency becomes higher to make the switched voltage lower in level. As a result, the switched voltage waveform G6 is shaped not as a sinusoidal wave having a ridge, but as a sinusoidal wave having a flat portion instead of the ridge. Consequently, there is no worry for the switched voltage to exceed the withstand voltage of the switch, thereby making it possible to prevent the switch from being damaged.

Notably, the flat portion where the switched voltage is limited in level corresponds to the period T where the frequency control pulse generator controls the switching frequency in the variable manner. The variable-frequency control period T is determined depending on the clamped voltage outputted from the input voltage detector. The positive (+) period T of the clamped voltage can be increased or reduced according to the number of series-connected diodes. In this connection, the manufacturer can regulate the variable-frequency control period by adjusting the number of clamping diodes appropriately according to the withstand voltage of the employed switch.

Figure 9:
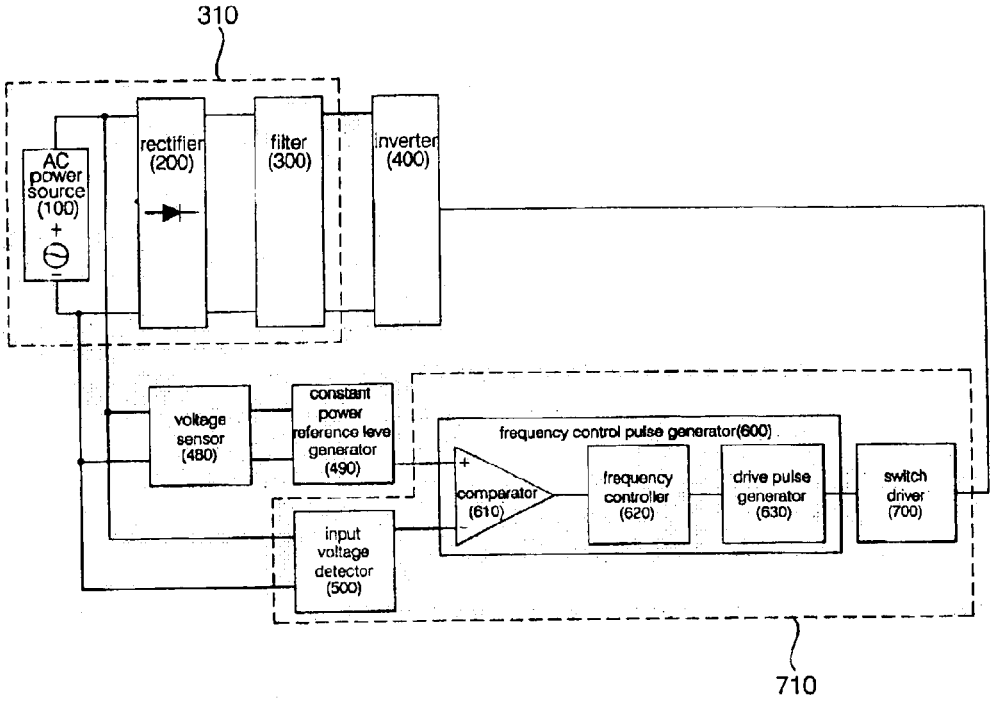
FIG. 9 is a block diagram showing a second embodiment of the inverter circuit of the induction heating rice cooker in accordance with the present invention.
Figure 10:
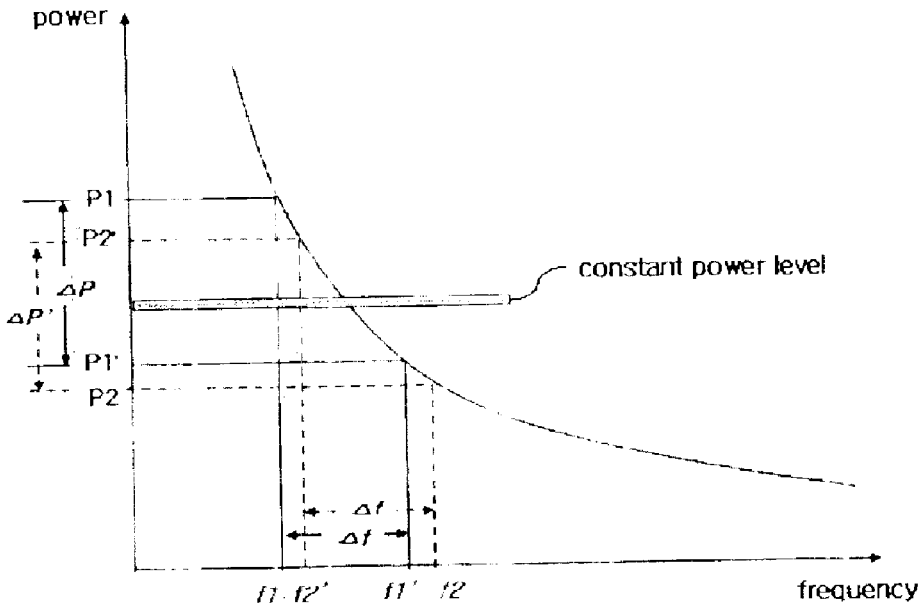
FIG. 10 is a graph illustrating a constant-power control method of the second embodiment of the inverter circuit.

Next, the construction and operation of the second embodiment of the present invention will be described with reference to FIGS. 9 and 10. FIG. 9 is a block diagram showing the second embodiment of the inverter circuit of the induction heating rice cooker in accordance with the present invention, and FIG. 10 is a graph illustrating a constant-power control method of the second embodiment of the inverter circuit. Some parts in the second embodiment are substantially the same in construction and operation as those in the first embodiment. Therefore, in the second embodiment, the same parts as those in the first embodiment are denoted by the same reference numerals and a detailed description thereof will thus be omitted.

Referring first to FIG. 9, the inverter circuit comprises the power supply circuit 310, inverter 400 and inverter driving circuit 710, which are substantially the same in construction and operation as those in the first embodiment. According to the second embodiment, the inverter circuit further comprises a voltage sensor 480 and a constant-power reference level generator 490. Besides, the frequency control pulse generator 600 is different in construction and operation from that in the first embodiment in that the constant-power reference level generator 490 is connected to an input terminal of the generator 600.

The power supply circuit 310 includes the AC power source 100, rectifier 200 and filter 300, as in the first embodiment. The voltage sensor 480 functions to sense a variation in the AC voltage supplied from the AC power source 100 and output the sensed variation to the constant-power reference level generator 490.

The constant-power reference level generator 490 is adapted to generate a constant-power reference level on the basis of the variation in the AC voltage sensed by the voltage sensor 480 so that the heating power of the rice cooker does not vary with the variation in the AC voltage.

The inverter driving circuit 710 includes the input voltage detector 500, frequency control pulse generator 600 and switch driver 700, and serves to generate a drive pulse based on a difference between the constant-power reference level and the AC voltage level to control the switching frequency of the inverter 400 in the variable manner so as to maintain the power of the inverter 400 at a constant level.

The frequency control pulse generator 600 includes a comparator 610 for comparing a voltage level of an output voltage signal from the input voltage detector 500 with the constant-power reference level generated from the constant-power reference level generator 490 and outputting the comparison result, a frequency controller 620 for outputting a frequency control signal in accordance with the comparison result from the comparator 610 to control the switching frequency of the inverter 400 in the variable manner, and a drive pulse generator 630 for adjusting a pulse width in response to the frequency control signal from the frequency controller 620 and generating a drive pulse having the adjusted pulse width.

If the voltage level of the output voltage signal from the input voltage detector 500 is higher than the constant-power reference level, the frequency controller 620 outputs the frequency control signal such that the inverter 400 performs the switching operation at a higher frequency to lower its power. To the contrary, if the voltage level of the output voltage signal from the input voltage detector 500 is lower than the constant-power reference level, the frequency controller 620 outputs the frequency control signal such that the inverter 400 performs the switching operation at a lower frequency to raise its power.

The drive pulse, generated according to the frequency control of the frequency control pulse generator 600, is transferred via the switch driver 700 to the inverter 400, which then performs the switching operation in response to the transferred drive pulse. As a result, according to the present embodiment, the heating power of the rice cooker has the same level as the constant-power reference level.

The constant-power control method of the second embodiment of the inverter circuit with the above-stated construction will hereinafter be described with reference to the graph of FIG. 10.

First, the constant-power reference level generator generates the constant-power reference level on the basis of a variation in the AC voltage from the AC power source, and the frequency control pulse generator compares the level of the AC voltage with the constant-power reference level and varies the switching frequency of the inverter by a difference therebetween to correction-control the switching frequency. Therefore, the power of the inverter is controlled so that it is maintained at a constant level. The switching frequency is varied only within the range of a minimum frequency f1 to a maximum frequency f2, and the heating power level is thus limited to within the range of a minimum power level P2 to a maximum power level P1.

If the AC voltage from the AC power source exceeds the constant-power reference level (constant power level), the frequency control pulse generator widens the range of the switching frequency of the inverter by Δf so that it exists between f2' and f2. As a result, the power of the inverter is lowered by ΔP'.

To the contrary, provided that the AC voltage from the AC power source is below the constant-power reference level, the frequency control pulse generator narrows the range of the switching frequency of the inverter by Δf so that it exists between f1 and f1'. As a result, the power of the inverter is raised by ΔP. Consequently, the power of the inverter is maintained at a constant level. Here, ΔP' is greater than or equal to P2 and less than P2', and ΔP is greater than or equal to P1' and less than P1.

The frequency control pulse generator 600 is preferably implemented with an IC, and the internal circuit construction thereof will hereinafter be described in detail with reference to FIGS. 11*a* to 11*c*.

The frequency control pulse generator 600 is adapted to generate a drive pulse to variably control the switching frequency of the inverter 400 according to an input voltage and drive the inverter 400 at the controlled switching frequency. The frequency control pulse generator 600 then transfers the generated drive pulse to the inverter 400 through two output terminals to control the switching operation of the inverter 400. To this end, the frequency control pulse generator 600 is preferably implemented with an IC, more preferably an updated version of MC34067 chip.

The IC for the frequency control pulse generator 600 basically includes a voltage input terminal 601 for inputting a supply voltage Vcc, an undervoltage lockout (UVLO) terminal 602 for shutting down the entire operation of the IC when the supply voltage Vcc is below a predetermined reference level, an oscillator 603 for frequency variation, a pair of output terminals 604 for outputting a drive pulse, and an error detector 605 for deactivating the output of the drive pulse upon error detection to stop the operation of the inverter 400 downstream thereof.

The IC can be operated at three types of voltage levels depending on methods for coupling the voltage input terminal 601 with the UVLO terminal 602 which shuts down the circuit system to protect the circuit when the supply voltage Vcc inputted from the voltage input terminal 601 is below the predetermined reference level. Thus, the manufacturer can adjust an enable ON level and a disable OFF level by wiring the voltage input terminal 601 and the UVLO terminal 602 according to an operating range of the device employing the IC, as in the below table 1.

TABLE 1

| | LEVEL | |
|---|---|---|
| STATE | ON VOLTAGE LEVEL | OFF VOLTAGE LEVEL |
| CLOSED | 9.0 V | 8.6 V |
| OPEN | 16.0 V | 9.0 V |
| UVLO TERMINAL GROUNDED | IC OPERATION SHUT DOWN | |

That is, in the case where the voltage input terminal 601 and the UVLO terminal 602 are closed, the IC is turned on when the supply voltage is higher than or equal to 9.0V, and off when it is lower than or equal to 8.6V.

To the contrary, in the case where the voltage input terminal 601 and the UVLO terminal 602 are open, the IC is turned on when the supply voltage is higher than or equal to 16V, and off when it is lower than or equal to 9.0V. Meanwhile, provided that the UVLO terminal 602 is connected to a ground terminal, the IC is shut down to be turned off. This is mainly used for forced initialization of the IC.

The error detector 605 is adapted to sense an error signal that the inverter 400 outputs due to the flow of overcurrent in the switch or the occurrence of an error in the switching operation. The error detector 605 also compares the level of the error signal from the inverter 400 with a predetermined error determination reference level and, if the error signal level is above the error determination reference level, generates an error detection signal to deactivate the output of the drive pulse from the output terminals 604.

If the error detection signal is "high" in level, the output of the drive pulse from the output terminals 604 is deactivated to stop the operation of the inverter 400. However, if the error detection signal is "low" in level, a latch 606 is reset owing to removal of the detected error. The latch 606 is connected to the error detector 605 to initialize it.

To this end, a resetting unit 607 is disposed upstream of the UVLO terminal 602 to receive the error signal from the inverter 400, sensed by the error detector 605. The resetting unit 607 can be implemented as first and second embodiments depending on its different connections, and serves to, when the level of the error signal from the inverter 400 is above the predetermined error determination reference level of the error detector 605, shut down the operation of the IC to prevent the switch of the downstream inverter 400 from being damaged.

In this regard, the IC can be forcibly reset by lowering the supply voltage Vcc to the IC to a level at which the UVLO terminal 602 can turn off the IC, after the lapse of a minimum propagation delay time required from the input of the error signal to the deactivation of the drive pulse output. Alternatively, the IC may be forcibly reset by connecting the UVLO terminal 602 to the ground terminal.

As seen from the above table 1, the voltage input terminal 601 and the UVLO terminal 602 can be closed or open to apply the IC appropriately to desired voltage levels. FIG. 11*a* shows an embodiment of the IC wherein the two terminals are closed, and FIG. 11*b* shows an alternative embodiment of the IC wherein the two terminals are open.

The resetting unit 607 includes a diode, and a transistor having its base connected to the diode, its collector connected to the supply voltage Vcc and its emitter connected to the ground terminal. The error signal from the inverter 400 is inputted to the resetting unit 607, as shown in FIG. 11*a*.

Where the error signal from the inverter 400 is "1" in logic, the diode and transistor are turned on to connect the supply voltage Vcc to the ground terminal, thereby causing the level of the supply voltage Vcc at the voltage input terminal 601 to be lowered. As a result, the IC can be forcibly shut down to be initialized, according to the UVLO function of turning off the IC when the supply voltage Vcc at the voltage input terminal 601 is below the predetermined reference level.

Figure 11A:
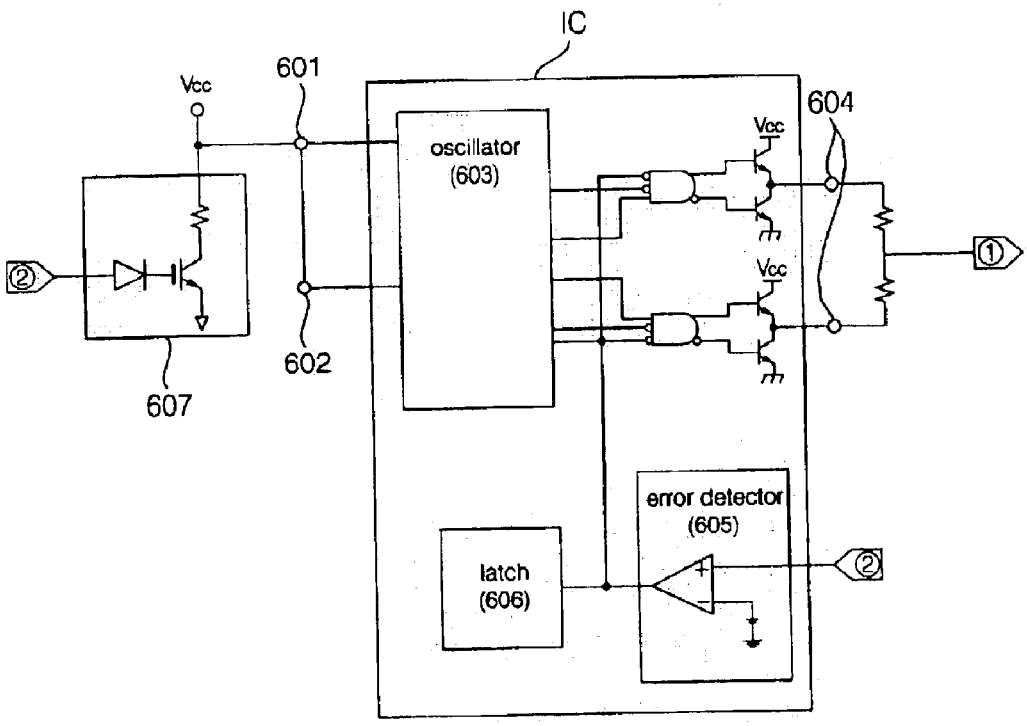
FIGS. 11*a* to 11*c* are circuit diagrams showing different embodiments of a frequency control pulse generator applied to the present invention.
Figure 11B:
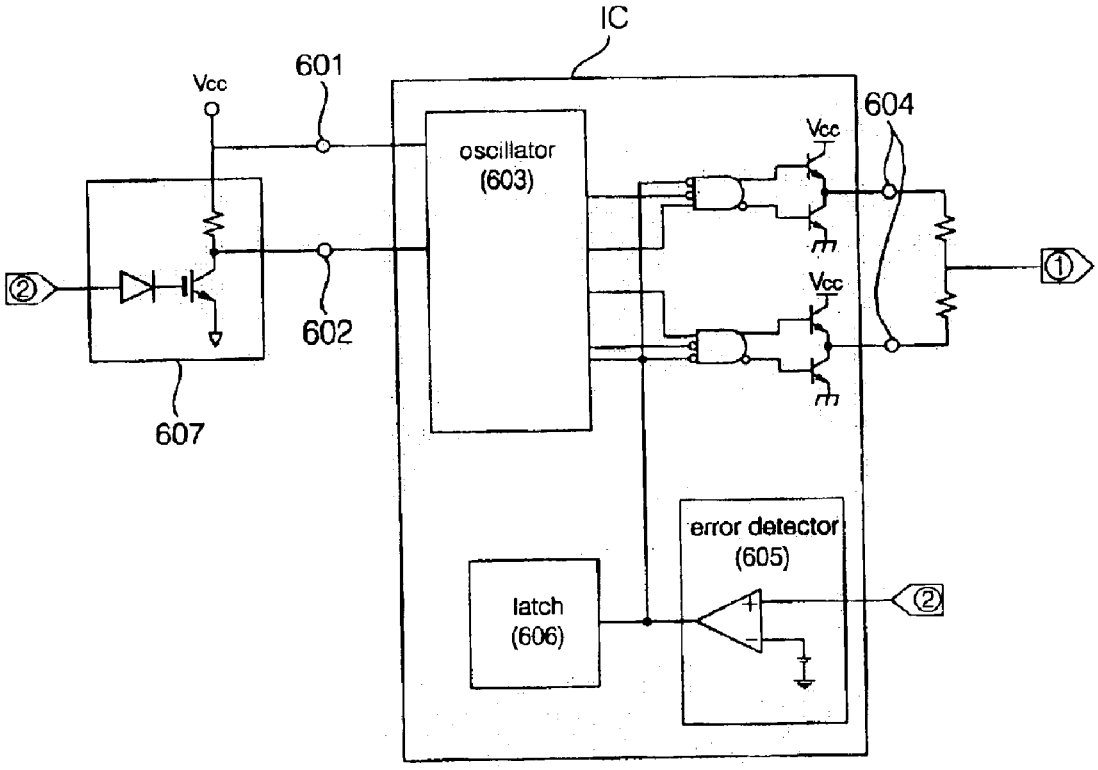

Similarly, in the circuit configuration as shown in FIG. 11*b*, if the error signal from the inverter 400 is"1" in logic, the diode and transistor are turned on to connect the UVLO terminal 602 directly to the ground terminal, thereby causing the IC to be forcibly shut down. In this case, the manufacturer can select a resistance in consideration of a desired voltage level.

Figure 11C:
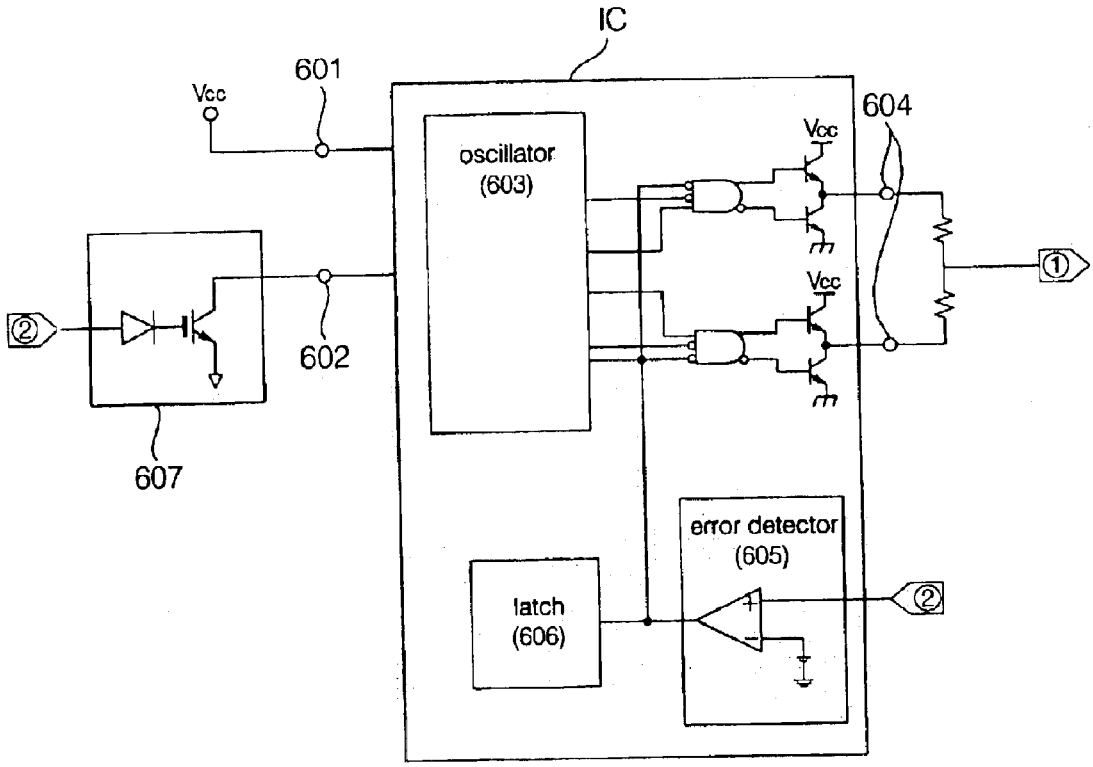

Also similarly, in another embodiment of the IC as shown in FIG. 11*c*, the voltage input terminal 601 and the UVLO terminal 602 are open and a resetting unit 607' is disposed upstream of the UVLO terminal 602. If the error signal from the inverter 400 is inputted, the diode and transistor are turned on to connect the UVLO terminal 602 to the ground terminal, thereby causing the IC to be reset.

Figure 12A:
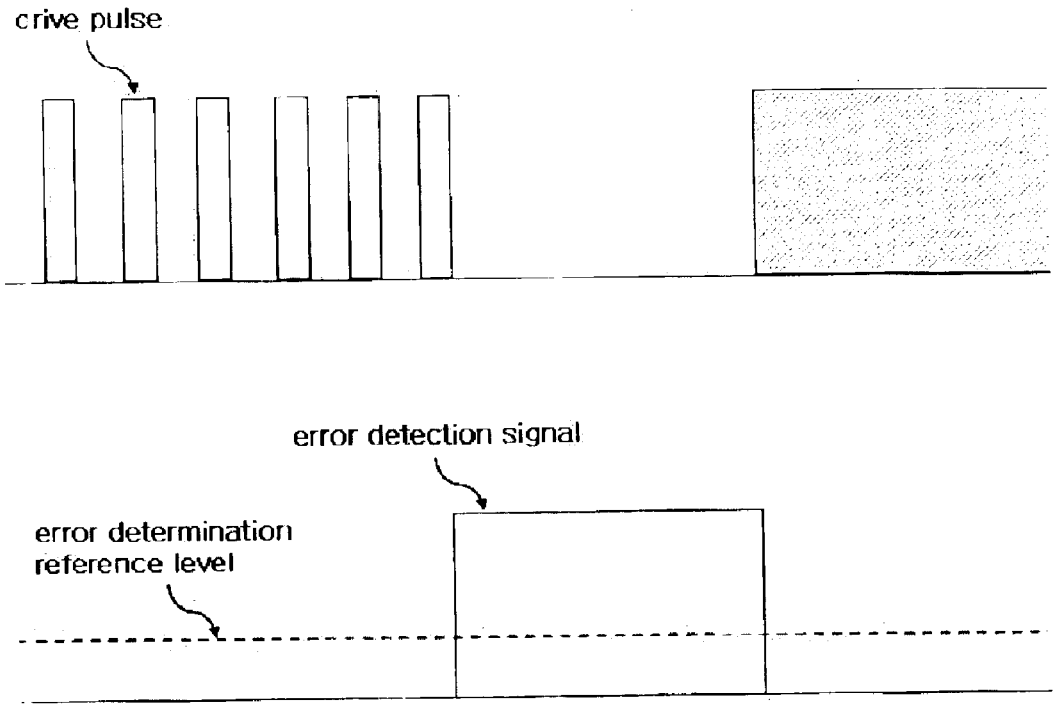
FIG. 12*a* is a waveform diagram of a drive pulse generated from a conventional frequency control pulse generator.
Figure 12B:
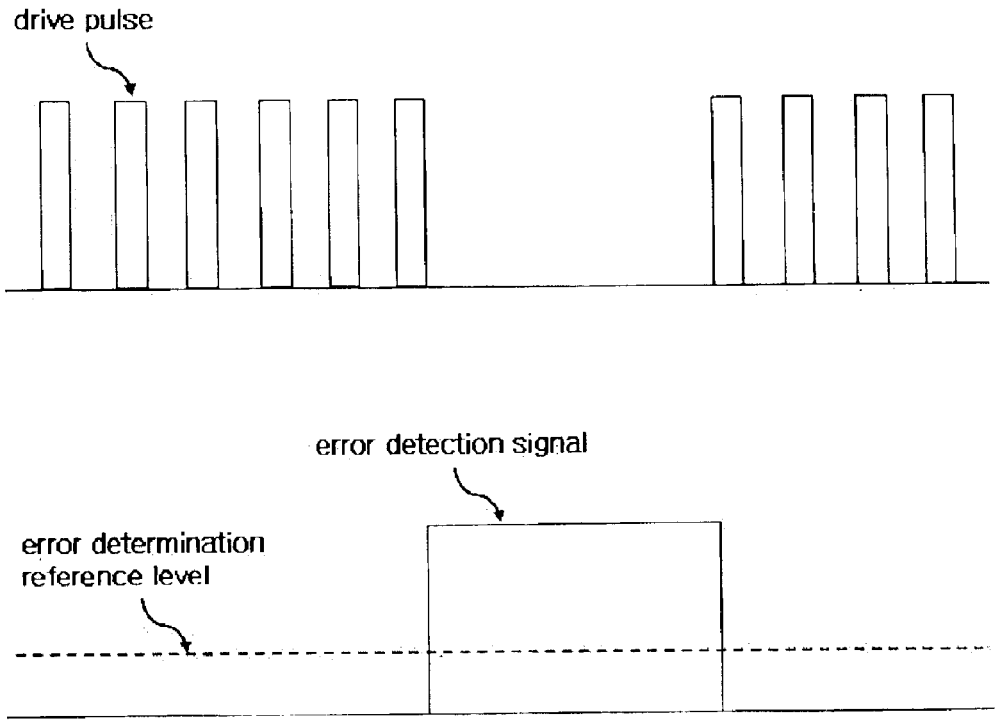
FIG. 12*b* is a waveform diagram of a drive pulse generated from the frequency control pulse generator applied to the present invention.

If the resetting unit 607 or 607' is disposed upstream of the UVLO terminal 602 to perform the forced resetting operation as described above, the resulting waveforms can be obtained as shown in FIG. 12*b*. FIG. 12*a* shows the resulting waveforms obtained through a conventional IC excluding the resetting unit 607 or 607'. A description will hereinafter be given of the comparison between the waveforms of FIG. 12*a* and the waveforms of FIG. 12*b*.

The upper waveform of FIG. 12*a* corresponds to the drive pulse which is outputted from the output terminals 604 to the inverter 400, and the lower waveform thereof corresponds to the error detection signal which is outputted from the error detector 605.

If the level of the error signal inputted to the error detector is above the error determination reference level, the error detection signal makes a low to high transition to deactivate the output of the drive pulse from the output terminals. Thereafter, if the detected error is removed, then the latch connected to the error detector is reset to re-activate the operation of the IC.

In the case where the error detection signal is outputted in the initial operation, the latch is automatically reset by the UVLO function of the IC. Thereafter, if the error detection signal is outputted in the normal operation, the latch is reset by connecting the UVLO terminal of the IC to the ground terminal. Provided that an error occurs during the switching operation of the inverter 400 under the condition that the latch is not reset, the inverter 400 generates an error signal again and outputs the generated error signal to the error detector 605.

The error detector 605 compares the level of the error signal from the inverter 400 with the predetermined error determination reference level. The variable-frequency control IC (MC34067 chip) is internally designed to output through the second output terminal a drive pulse which is continuously "high" in level, if the error signal level is less than the predetermined error determination reference level.

Of course, there is no problem with the use of only the first output terminal. However, for the use of only the second output terminal or both the first and second output terminals, the continuous high-level drive pulse as stated above, namely, overvoltage is applied to the downstream inverter, resulting in a risk that the switch of the inverter may be damaged.

On the other hand, the waveforms of FIG. 12*b* are generated from the circuit configurations, as shown in FIGS. 11*a* to 11*c*, wherein the resetting unit is provided at the input of the IC to rapidly reset the latch against the input of an error signal of a weak level from the inverter 400 in the case of the use of both the first and second output terminals. The upper waveform of FIG. 12*b* corresponds to the drive pulse which is outputted from the output terminals, and the lower waveform thereof corresponds to the error detection signal which is outputted from the error detector.

Even though the level of the error signal from the inverter is less than the error determination reference level after the error detection signal makes a high to low transition owing to removal of the erroneous state, the resetting unit forcibly resets the latch in response to the error signal so that a normal drive pulse can be outputted from the output terminals. Therefore, both the two output terminals can be stably used.

As apparent from the above description, the present invention provides an inverter circuit of an induction heating rice cooker which is capable of controlling a switching frequency of an inverter in a variable manner according to a variation in an input voltage to the inverter circuit and driving a switch of the inverter at the controlled switching frequency to limit a peak value of a switched voltage across the switch to less than a predetermined level, thereby securing a margin of the switched voltage with respect to the input voltage. Therefore, the switch can be prevented from being damaged due to an excess of the switched voltage over a withstand voltage of the switch, so as to enhance durability of the inverter circuit. Further, a variation in heating power with the variation in the input voltage can be minimized, thereby enhancing stability and reliability of the heating cooking. Furthermore, there is no need to employ a high-cost switch with a high withstand voltage, thereby making it possible to suppress an increase in production cost and in turn secure the price competitiveness of a product.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An inverter circuit of an induction heating rice cooker, comprising:

power supply means for rectifying and filtering a commercial AC voltage to supply an input voltage to said induction heating rice cooker;

an inverter for performing a switching operation based on said input voltage from said power supply means to heat said rice cooker;

constant-power reference level generation means for generating a constant-power reference level of said rice cooker on the basis of a variation in said AC voltage and a variation in a load of said cooker; and inverter driving means for outputting a drive pulse to control a switching frequency of said inverter in a variable manner according to a difference between said constant-power reference level and a level of said AC voltage so as to maintain power of said inverter at a constant level.

2. The inverter circuit as set forth in claim 1, wherein said power supply means includes:

an AC power source for supplying said AC voltage to said induction heating rice cooker;

a rectifier for rectifying said AC voltage supplied from said power source; and a filter for filtering an output direct current (DC) voltage from said rectifier to output said input voltage.

3. The inverter circuit as set forth in claim 1, further comprising voltage sensing means for sensing a variation in said AC voltage and outputting the sensed variation to said constant-power reference level generation means.

4. The inverter circuit as set forth in claim 3, wherein said inverter driving means includes:

input voltage detection means for outputting a voltage signal to limit a variable-frequency control period according to a level of said AC voltage;

frequency control pulse generation means for generating said drive pulse as a result of comparison between a voltage level of said voltage signal from said input voltage detection means and said constant-power reference level from said constant-power reference level generation means to control said switching frequency of said inverter in said variable manner; and a switch driver for transferring said drive pulse from said frequency control pulse generation means to said inverter to drive a switch of said inverter.

5. The inverter circuit as set forth in claim 4, wherein said frequency control pulse generation means includes:

a comparator for comparing said voltage level of said voltage signal from said input voltage detection means with said constant-power reference level from said constant-power reference level generation means and outputting the comparison result;

a frequency controller for outputting a frequency control signal in accordance with the comparison result from said comparator to control said switching frequency of said inverter in said variable manner; and a drive pulse generator for adjusting a pulse width in response to said frequency control signal from said frequency controller and generating said drive pulse having the adjusted pulse width.

6. The inverter circuit as set forth in claim 5, wherein said frequency controller is adapted to output said frequency control signal to narrow the pulse width of said drive pulse if said voltage level of said voltage signal from said input voltage detection means is higher than said constant-power reference level and to widen the pulse width of said drive pulse if said voltage level of said voltage signal from said input voltage detection means is lower than said constant-power reference level.

7. The inverter circuit as set forth in claim 4, wherein said frequency control pulse generation means includes a pair of output terminals for transferring said drive pulse to said inverter.

8. The inverter circuit as set forth in claim 7, wherein said frequency control pulse generation means further includes:

an error detector for deactivating the output of said drive pulse from said output terminals upon detecting an error in said switching operation of said inverter; and resetting means for, if the error in said switching operation of said inverter is detected, forcibly shutting down a circuit system of said frequency control pulse generation means to initialize it.

9. The inverter circuit as set forth in claim 8, wherein said frequency control pulse generation means further includes:

a voltage input terminal connected to said input voltage detection means; and an undervoltage lockout (UVLO) terminal connected in parallel to said voltage input terminal for shutting down said circuit system if an input voltage from said voltage input terminal is below a predetermined reference level.

10. The inverter circuit as set forth in claim 9, wherein said frequency control pulse generation means is adapted to set said predetermined reference level to different values depending on whether said voltage input terminal and said UVLO terminal are closed or open.

11. The inverter circuit as set forth in claim 10, wherein said frequency control pulse generation means is adapted to shut down said circuit system when said UVLO terminal is connected to a ground terminal.

12. The inverter circuit as set forth in claim 9, wherein said resetting means is adapted to, if an error signal from said inverter is "1" in logic, connect said UVLO terminal to a ground terminal to shut down said circuit system, said error signal being generated by said inverter in response to occurrence of an error in said switching operation.

13. The inverter circuit as set forth in claim 12, wherein said resetting means includes:

a diode having its anode for receiving said error signal from said inverter; and a transistor having its base connected to a cathode of said diode, its collector connected to said voltage input terminal and its emitter connected to said ground terminal.

14. The inverter circuit as set forth in claim 12, wherein said resetting means includes:

a diode having its anode for receiving said error signal from said inverter; and a transistor having its base connected to a cathode of said diode, its collector connected to said UVLO terminal and its emitter connected to said ground terminal.

15. The inverter circuit as set forth in claim 8, wherein said error detector is adapted to compare a level of an error signal from said inverter with an error determination reference level, said error determination reference level being predetermined for determination about whether an error has occurred in said switching operation of said inverter, and deactivate the output of said drive pulse from said output terminals, if said error signal level is above said error determination reference level.

* * * * *